US011306481B2

(12) United States Patent
Wu et al.

(10) Patent No.: US 11,306,481 B2
(45) Date of Patent: Apr. 19, 2022

(54) ENVIRONMENT-FRIENDLY ACOUSTIC PANEL FOR BUILDING

(71) Applicant: CHINA CONSTRUCTION FIRST GROUP CORPORATION LIMITED, Beijing (CN)

(72) Inventors: Yongzai Wu, Beijing (CN); Wei Kong, Beijing (CN); Jiwei Zhou, Beijing (CN); Pengbo Su, Beijing (CN); Hongyu Shi, Beijing (CN); Quan Li, Beijing (CN); Xipeng Yi, Beijing (CN); Ruixuan Tao, Beijing (CN); Zhen Wang, Beijing (CN)

(73) Assignee: CHINA CONSTRUCTION FIRST GROUP CORPORATION LIMITED, Beijing (CN)

( * ) Notice: Subject to any disclaimer, the term of this patent is extended or adjusted under 35 U.S.C. 154(b) by 0 days.

(21) Appl. No.: 17/447,630

(22) Filed: Sep. 14, 2021

(65) Prior Publication Data

US 2022/0081903 A1 Mar. 17, 2022

(30) Foreign Application Priority Data

Sep. 15, 2020 (CN) ..... 202010968285.3

(51) Int. Cl.
*E04B 2/00* (2006.01)
*E04C 2/38* (2006.01)
(Continued)

(52) U.S. Cl.
CPC ..... *E04C 2/388* (2013.01); *E04B 1/6125* (2013.01); *E04B 1/86* (2013.01); *E04C 2002/004* (2013.01)

(58) Field of Classification Search
None
See application file for complete search history.

(56) References Cited

U.S. PATENT DOCUMENTS 1,928,034 A * 9/1933 Schulstadt ..... E04B 1/86 181/290
1,929,751 A * 10/1933 MacDonell ..... E04B 1/8409 52/603
(Continued)

FOREIGN PATENT DOCUMENTS

CN 107299736 A 10/2017
CN 207110100 A 3/2018
(Continued)

*Primary Examiner* — Basil S Katcheves
(74) *Attorney, Agent, or Firm* — CBM Patent Consulting, LLC

(57) ABSTRACT

Disclosed is an environment-friendly acoustic panel for building, including an acoustic panel which includes a first positioning groove and a second positioning groove, a positioning cylinder with open top and bottom ends being arranged in the first positioning groove in a length direction of the first positioning groove, the positioning cylinder being provided with an opening in an outer side wall of the first positioning groove, and a fixing block being arranged in the second positioning groove; two sets of sealing assemblies, the sealing assembly including an accommodating groove, a bottom portion of the accommodating groove being provided with a plurality of springs at intervals up and down, end portions of the plurality of springs are jointly connected with a positioning plate, and a surface of the positioning plate facing away from the springs being fixedly provided with a sealing block.

8 Claims, 3 Drawing Sheets

(51) Int. Cl.

| | |
|---|---|
| ***E04B 1/61*** | (2006.01) |
| ***E04B 1/86*** | (2006.01) |
| *E04C 2/00* | (2006.01) |

(56) References Cited

U.S. PATENT DOCUMENTS

| | | | | | |
|---|---|---|---|---|---|
| 2,350,513 | A * | 6/1944 | Leadbetter | E04B 1/86 | 52/794.1 |
| 3,103,254 | A * | 9/1963 | Stedman | B28B 5/021 | 425/73 |
| 3,479,779 | A * | 11/1969 | Ziegler | E04C 2/284 | 52/309.11 |
| 3,498,405 | A * | 3/1970 | Charpentier | E04B 1/86 | 181/291 |
| 3,507,355 | A * | 4/1970 | Lawson | F02K 1/827 | 181/292 |
| 3,651,887 | A * | 3/1972 | Eckel | E04B 1/617 | 52/145 |
| 4,566,558 | A * | 1/1986 | Link, Jr. | E01F 8/007 | 181/290 |
| 9,534,385 | B2 * | 1/2017 | Burr | G10K 11/16 | |

FOREIGN PATENT DOCUMENTS

| | | | |
|---|---|---|---|
| CN | 109083307 | A | 12/2018 |
| CN | 208702066 | A | 4/2019 |
| CN | 209163307 | A | 7/2019 |
| CN | 210086522 | A | 2/2020 |
| CN | 211037644 | A | 7/2020 |
| CN | 211201008 | A | 8/2020 |

* cited by examiner

ENVIRONMENT-FRIENDLY ACOUSTIC PANEL FOR BUILDING

TECHNICAL FIELD

The present invention relates to the technical field of building materials and devices. More specifically, the present invention relates to an environment-friendly acoustic panel for building.

BACKGROUND

An acoustic panel is a panel having acoustic insulation effects. The acoustic panels are different in air acoustic insulation and vibration acoustic insulation. An air acoustic panel refers to a panel that insulates a sound transmitting in air, while a vibration acoustic panel refers to a panel and a system insulating a sound transmitting in a rigid structure (such as a reinforced concrete monolithic house).

In order to avoid the influence of noises on surrounding residents during construction of a construction site, acoustic insulation is often implemented by arranging acoustic panels. An existing acoustic assembly is formed by connecting a plurality of acoustic panels, but the plurality of acoustic panels are threadedly connected, which leads to a gap at the joint, thus affecting the acoustic insulation effect.

SUMMARY

An object of the present invention is to solve at least the above problems and to provide at least advantages that will be described hereinafter.

Another object of the present invention is to provide an environment-friendly acoustic panel for building, which, by arranging a fixing block at a joint, can effectively avoid a gap at the joint of two acoustic panel bodies, so that an acoustic insulation effect of the acoustic panel is improved.

In order to achieve these objects and other advantages according to the present invention, an environment-friendly acoustic panel for building is provided, including:

an acoustic panel body, which includes a first positioning groove formed by recessing of one vertical edge of the acoustic panel body and a second positioning groove formed by recessing of the other vertical edge of the acoustic panel body, wherein the first positioning groove is arranged in a vertical length direction of the acoustic panel body and a length of the first positioning groove is equal to a vertical length of the acoustic panel body, a horizontal cross section of the first positioning groove is a semi-circular arc, a positioning cylinder with open top and bottom ends is fixedly arranged in the first positioning groove in a length direction of the first positioning groove, a length of the positioning cylinder is equal to that of the first positioning groove, the positioning cylinder is provided with an opening in an outer side wall of the first positioning groove, the opening is arranged in a length direction of the positioning cylinder and a length of the opening is equal to that of the positioning cylinder, the second positioning groove is arranged in a vertical length of the acoustic panel body and a length of the second positioning groove is equal to the vertical length of the acoustic panel body, a horizontal cross section of the second positioning groove is a semi-circular arc, a fixing block is arranged in the second positioning groove, the fixing block includes a vertical portion arranged in a length direction of the second positioning groove and an arc-shaped portion integrally formed with the vertical portion, a horizontal cross section of the arc-shaped portion is a major arc and a diameter of the major arc is larger than a width of the vertical portion, wherein the width of the vertical portion is slightly smaller than a width of the opening; and two sets of sealing assemblies, wherein the two sets of sealing assemblies are respectively arranged in one-to-one correspondence with two vertical edges of the opening, the sealing assembly includes an accommodating groove formed by outwardly recessing of the vertical edge of the opening, a length of the accommodating groove is slightly smaller than the length of the opening, a bottom portion of the accommodating groove is provided with a plurality of springs at intervals up and down, end portions of the plurality of springs are jointly connected with a positioning plate, a length of the positioning plate is slightly smaller than that of the accommodating groove, the positioning plate is slidably connected with a side wall of the accommodating groove, a surface of the positioning plate facing away from the springs is fixedly provided with a sealing block, and the sealing block is hermetically and slidably connected with the side wall of the accommodating groove, wherein two steel wire ropes are connected onto a surface of the positioning plate connected with the springs, the two steel wire ropes are respectively located at an upper portion and a lower portion of the positioning plate, the steel wire rope located at the upper portion slides through a top end of the positioning cylinder, while the steel wire rope located at the lower portion slides through a bottom end of the positioning cylinder;

when two acoustic panel bodies are connected, the arc-shaped portion of one acoustic panel body is located in the positioning cylinder of the other acoustic panel body, two sealing blocks corresponding to the positioning cylinder abut against the vertical portion, top ends and bottom ends of the two acoustic panel bodies are flush, and surfaces of the two acoustic panel bodies are flush.

Preferably, the top end and the bottom end of the positioning cylinder are both provided with a through hole, the through hole is communicated with the accommodating groove, two fixed pulleys are arranged between the bottom portion of the accommodating groove and the positioning plate, the two fixed pulleys are arranged in one-to-one correspondence with the two steel wire ropes, and a free end of the steel wire rope sequentially passes through the fixed pulley and the through hole corresponding to the free end of the steel wire rope and then extends out of the accommodating groove.

Preferably, the free ends of the steel wire ropes are both provided with a positioning ring; and four sets of fixing assemblies are further, the four sets of fixing assemblies are arranged in one-to-one correspondence with four through holes, each set of fixing assembly includes a fixing groove formed by recessing of an end portion of the positioning cylinder, a fixing column is hinged in the fixing groove, and a rotation angle of the fixing column is 90°.

Preferably, four cover bodies are further included, the four cover bodies are respectively arranged in one-to-one correspondence with the top ends and the bottom ends of the first positioning groove and the second positioning groove, when the two acoustic panel bodies are connected, the cover bodies at the joint of the two acoustic panel bodies are closed and then respectively connected with the top ends and the bottom ends of the first positioning groove and the second positioning groove.

Preferably, the vertical portion and the arc-shaped portion are both of a hollow structure, the vertical portion is communicated with the arc-shaped portion, and acoustic insulation materials are filled in the vertical portion and the arc-shaped portion.

Preferably, the acoustic insulation materials are filled in the positioning cylinder and a gap between the second positioning groove and the positioning cylinder at the joint of the two acoustic panel bodies.

Preferably, the acoustic insulation materials are acoustic insulation cotton.

Preferably, a sealing rubber layer is coated on a side wall of the positioning cylinder outside the first positioning groove.

The present invention at least includes the following advantageous effects:

Firstly, the fixing block is arranged at the joint, so that the gap at the joint of two acoustic panel bodies can be effectively avoided by the present invention, and the acoustic insulation effect of the acoustic panel is improved. Meanwhile, the present invention is convenient for the assembly and disassembly of the acoustic panel body, and is beneficial to the repeated use of the acoustic panel body.

Secondly, the vertical portion and the arc-shaped portion are arranged. The acoustic insulation effect at the joint of the acoustic panel bodies can be effectively improved by setting the vertical portion. Compared with the prior art that two acoustic panels are connected by screwing, the vertical portion plays an acoustic insulation role at the joint through the vertical portion and has good acoustic insulation effect. The connection between the two acoustic panel bodies is realized by setting the arc-shaped portion, so that relative movement of the two acoustic panel bodies is avoided, and meanwhile, the disassembly and installation of the two acoustic panel bodies are facilitated.

Thirdly, the gap between the vertical portion and the opening can be reduced by setting the sealing assembly, which can further improve the acoustic insulation effect at the joint of the acoustic panel bodies. The end face of the sealing block is driven to be located in the accommodating groove by the wire rope, and the damage of the sealing block caused by the vertical portion moving out or moving into the opening can be reduced, which not only can effectively prolong a service life of the sealing block, but also can improve a sealing effect of the sealing block. When the vertical portion moves into the opening, the spring drives the positioning plate to move so as to push the sealing block to move in the direction away from the bottom portion of the accommodating groove until the end face of the sealing block abuts against the side wall of the vertical portion, which can effectively improve a sealing performance of the sealing block and further improve the acoustic insulation effect at the joint of the acoustic panel bodies.

Fourthly, the positioning ring and the fixing assembly are arranged. By setting the positioning ring, not only can the positioning ring be sleeved on the fixing column to fix the steel wire rope, but also the free end of the steel wire rope can be fixed, so that the steel wire rope is prevented from escaping from the through hole. Meanwhile, by setting the fixing column, the sealing block can be kept away from the groove opening of the accommodating groove by fixing the steel wire rope, so as to facilitate the vertical portion to move in or out of the opening, reduce the influence of the vertical portion on the sealing block in the moving process, and prolong the service life of the sealing block.

Fifthly, the cover bodies are arranged. On one hand, the two cover bodies arranged up and down can effectively improve the connection stability of the two acoustic panel bodies and prevent the two acoustic panel bodies from moving up and down. On the other hand, the cover bodies can protect the first positioning groove, the positioning cylinder, the second positioning groove and the fixing block after being closed, thus effectively improving the acoustic insulation effect.

Other advantages, objects and features of the present invention will be partially reflected by the following description, and will be partially understood by those skilled in the art through researching and practicing the present invention.

DETAILED DESCRIPTION

Figure 1:
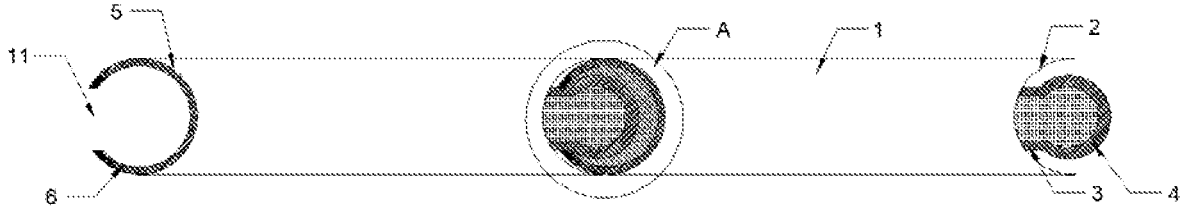
FIG. 1 is a schematic structural diagram of an environment-friendly acoustic panel for building according to one of the technical solutions of the present invention.
Figure 2:
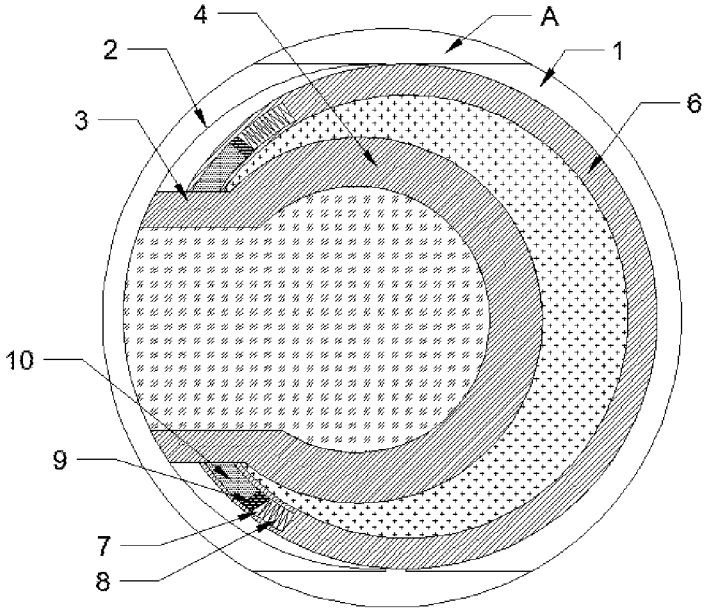
FIG. 2 is an enlarged drawing of A in FIG. 1.

The present invention will be further described in detail hereinafter with reference to the accompanying drawings, so that those skilled in the art can implement the present invention with reference to the specification.

As shown in FIGS. 1 to 6, the present invention provides an environment-friendly acoustic panel for building, including:

an acoustic panel body 1, which includes a first positioning groove 5 formed by recessing of one vertical edge of the acoustic panel body 1 and a second positioning groove 2 formed by recessing of the other vertical edge of the acoustic panel body 1, wherein the first positioning groove 5 is arranged in a vertical length direction of the acoustic panel body 1 and a length of the first positioning groove 5 is equal to a vertical length of the acoustic panel body 1, (that is, a top end of the first positioning groove 5 is flush with a top end of the acoustic panel body 1, and a bottom end of the first positioning groove 5 is flush with a bottom end of the acoustic panel body 1), a horizontal cross section of the first positioning groove 5 is a semi-circular arc, a positioning cylinder 6 with open top and bottom ends is fixedly arranged in the first positioning groove 5 in a length direction of the first positioning groove, a length of the positioning cylinder 6 is equal to that of the first positioning groove 5, the positioning cylinder 6 is provided with an opening 11 in an outer side wall of the first positioning groove 5, the opening 11 is arranged in a length direction of the positioning cylinder 6 and a length of the opening 11 is equal to that of the positioning cylinder 6, the second positioning groove 2 is arranged in a vertical length of the acoustic panel body 1 and a length of the second positioning groove 2 is equal to the vertical length of the acoustic panel body 1, a horizontal cross section of the second positioning groove 2 is a semi-circular arc (that is, a top end of the second positioning groove 2 is flush with the top end of the acoustic panel body 1, and a bottom end of the first positioning groove 5 is flush with the bottom end of the acoustic panel body 1), a fixing block is arranged in the second positioning groove 2, the fixing block includes a vertical portion 3 arranged in a length direction of the second positioning groove 2 (a length of the vertical portion 3 is equal to a length of the opening 11) and an arc-shaped portion 4 integrally formed with the vertical portion 3, a horizontal cross section of the arc-shaped portion 4 is a major arc and a diameter of the major arc is larger than a width of the vertical portion 3 (a vertical length of the arc-shaped portion 4 is equal to a length of the vertical portion 3), wherein the width of the vertical portion 3 is slightly smaller than a width of the opening 11; and two sets of sealing assemblies, wherein the two sets of sealing assemblies are respectively arranged in one-to-one correspondence with two vertical edges of the opening 11, the sealing assembly includes an accommodating groove 7 formed by outwardly recessing of the vertical edge (i.e., side wall of the opening 11) of the opening 11, a length of the accommodating groove 7 is slightly smaller than the length of the opening 11, a bottom portion of the accommodating groove 7 is provided with a plurality of springs 8 at intervals up and down, end portions of the plurality of springs 8 are jointly connected with a positioning plate 9, a length of the positioning plate 9 is slightly smaller than that of the accommodating groove 7, so that the positioning plate 9 moves in the accommodating groove 7 in a depth direction of the accommodating groove 7, the positioning plate 9 is slidably connected with a side wall of the accommodating groove 7, a surface of the positioning plate 9 facing away from the springs 8 is fixedly provided with a sealing block 10, and the sealing block 10 is hermetically and slidably connected with the side wall of the accommodating groove 7, wherein two steel wire ropes 13 are connected onto a surface of the positioning plate 9 connected with the springs 8, the two steel wire ropes 13 are respectively located at an upper portion and a lower portion of the positioning plate 9, the steel wire rope 13 located at the upper portion slides through a top end of the positioning cylinder 6, while the steel wire rope 13 located at the lower portion slides through a bottom end of the positioning cylinder 6, so that the positioning plate 9 is driven to move towards the bottom portion of the accommodating groove 7 through the wire ropes 13.

When two acoustic panel bodies 1 are connected, the arc-shaped portion 4 of one acoustic panel body 1 is located in the positioning cylinder 6 of the other acoustic panel body 1, two sealing blocks 10 corresponding to the positioning cylinder 6 abut against the two side walls of the vertical portion 3 respectively, top ends and bottom ends of the two acoustic panel bodies 1 are flush, and surfaces of the two acoustic panel bodies 1 are flush (that is, the side walls of the two acoustic panel bodies 1 are flush.

Figure 3:
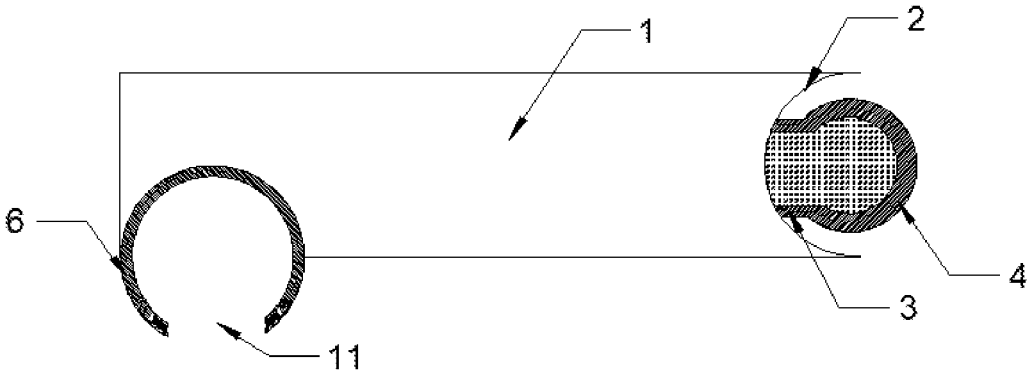
FIG. 3 is a schematic structural diagram of an environment-friendly acoustic panel for building according to one of the technical solutions of the present invention.
Figure 4:
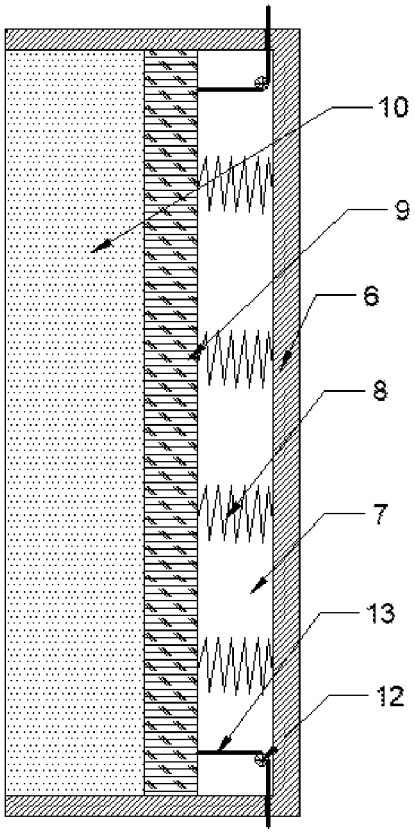
FIG. 4 is a schematic structural diagram of a sealing assembly according to one of the technical solutions of the present invention.

In this technical solution, the two ends of the acoustic panel body 1 are respectively provided with the first positioning groove 5 and the second positioning groove 2, a width of the first positioning groove 5 is slightly smaller than a thickness of the acoustic panel body 1, an outer diameter of the positioning cylinder 6 is slightly smaller than the width of the first positioning groove 5, the top end and the bottom end of the positioning cylinder 6 are both open, the top end of the positioning cylinder 6 is flush with the top end of the first positioning groove 5, the bottom end of the positioning cylinder 6 is flush with the bottom end of the first positioning groove 5, a width of the second positioning groove 2 is equal to that of the first positioning groove 5, the vertical portion 3 bisects a width of a groove opening of the second positioning groove 2, the bottom portion of the accommodating groove 7 are provided with the plurality of springs 8 at intervals in the vertical direction, and the positioning plate 9 is connected with the free ends of the springs 8. In order to improve the application range of the acoustic panel bodies 1, in use, some of the plurality of acoustic panel bodies 1 may be specifically arranged as follows: the second positioning groove 2 may be arranged on the side wall of the acoustic panel body 1 (i.e., formed by the recessing of the side wall of the acoustic panel body 1), and the second positioning groove 2 is arranged far away from the first positioning groove 5, that is, two baffle bodies 1 are connected to form an included angle of 90 degrees (as shown in FIG. 3).

In use, the sealing block 10 is moved by the steel wire rope 13 until an end face of the sealing block 10 is located in the accommodating groove 7, and then vertical portion 3 of one of the acoustic panel bodies 1 passes through the opening 11 of the other acoustic panel body 1 until the arc-shaped portion 4 is completely located in the positioning cylinder 6. In this case, the top ends and the bottom ends of the two acoustic panel bodies 1 are flush. After that, the wire rope 13 is loosened, so that the spring 8 drives the sealing block 10 to move until the end face of the sealing block 10 abuts against the side wall of the vertical portion 3. After use, the wire rope 13 is pulled until the end face of the sealing block 10 is located in the accommodating groove 7, and the vertical portion 3 and the arc-shaped portion 4 are separated from the positioning cylinder 6, that is, the two acoustic panel bodies 1 are separated.

According to this solution, the fixing block is arranged at the joint, so that the gap at the joint of two acoustic panel bodies 1 can be effectively avoided by the present invention, and the acoustic insulation effect of the acoustic panel is improved. Meanwhile, the present invention is convenient for the assembly and disassembly of the acoustic panel body 1, and is beneficial to the repeated use of the acoustic panel body 1. The vertical portion and the arc-shaped portion 4 are arranged. The acoustic insulation effect at the joint of the acoustic panel bodies 1 can be effectively improved by setting the vertical portion. Compared with the prior art that two acoustic panels are connected by screwing, the vertical portion 3 plays an acoustic insulation role at the joint and has good acoustic insulation effect. The connection between the two acoustic panel bodies 1 is realized by setting the arc-shaped portion 4, so that relative movement of the two acoustic panel bodies 1 is avoided, and meanwhile, the disassembly and installation of the two acoustic panel bodies 1 are facilitated. The gap between the vertical portion 3 and the opening 11 can be reduced by setting the sealing assembly, which can further improve the acoustic insulation effect at the joint of the acoustic panel bodies 1. The end face of the sealing block 10 is driven to be located in the accommodating groove 7 by the wire rope 13, and the damage of the sealing block 10 caused by the vertical portion 3 moving out or moving into the opening 11 can be reduced, which not only can effectively prolong a service life of the sealing block 10, but also can improve a sealing effect of the sealing block 10. When the vertical portion 3 moves into the opening 11, the spring 8 drives the positioning plate 9 to move so as to push the sealing block 10 to move in the direction away from the bottom portion of the accommodating groove 7 until the end face of the sealing block 10 abuts against the side wall of the vertical portion 3, which can effectively improve a sealing performance of the sealing block 10 and further improve the acoustic insulation effect at the joint of the acoustic panel bodies 1.

In another technical solution, the top end and the bottom end of the positioning cylinder 6 are both provided with through holes 15 (there are four through holes 15 on each positioning cylinder 6, which are arranged in one-to-one correspondence with the four steel ropes 13). The through hole is communicated with the accommodating groove, two fixed pulleys 12 are arranged between the bottom portion of the accommodating groove 7 and the positioning plate 9, the two fixed pulleys 12 are arranged in one-to-one correspondence with two steel wire ropes 13, and a free end of the steel wire rope 13 sequentially passes through the fixed pulley 12 and the through hole 15 corresponding to the free end of the steel wire rope 13 and then extends out of the accommodating groove 7. This technical solution is adopted to facilitate the movement of the wire rope 13.

In another technical solution, the free ends of the steel ropes 13 are all provided with a positioning ring 16 (a connection mode between the positioning ring 16 and the steel rope 13 may be as follows: the positioning ring 16 is provided with a positioning rod 17, the positioning rod 17 is provided with a fixing ring, a diameter of the fixing ring is greater than a diameter of the positioning rod 17 so that the fixing ring may rotate or move relative to the positioning rod, and a diameter of the positioning ring is greater than a diameter of the through hole 15).

Four sets of fixing assemblies are further included, the four sets of fixing assemblies are arranged in one-to-one correspondence with four through holes 15, each set of fixing assembly includes a fixing groove 18 formed by recessing of an end portion of the positioning cylinder 6, a fixing column 19 is hinged in the fixing groove 18, and a rotation angle of the fixing column 19 is 90°. In use, when the steel wire rope 13 needs to be fixed, the positioning ring 16 is sleeved on the fixing column 19, and the fixing column 19 is in a vertical state. When the sealing block 10 abuts against the vertical portion 3, the positioning ring 16 abuts against the through hole 15, so as to limit the position of the steel wire rope 13. According to this technical solution, the positioning ring 16 and the fixing assembly are arranged. By setting the positioning ring 16, not only can the positioning ring 16 be sleeved on the fixing column 19 to fix the steel wire rope 13, but also the free end of the steel wire rope 13 can be fixed, so that the steel wire rope 13 is prevented from escaping from the through hole 15. Meanwhile, by setting the fixing column 19, the sealing block 10 can be kept away from the groove opening of the accommodating groove 7 by fixing the steel wire rope 13, so as to facilitate the vertical portion 3 to move in or out of the opening 11, reduce the influence of the vertical portion 3 on the sealing block 10 in the moving process, and prolong the service life of the sealing block 10.

Figure 5:
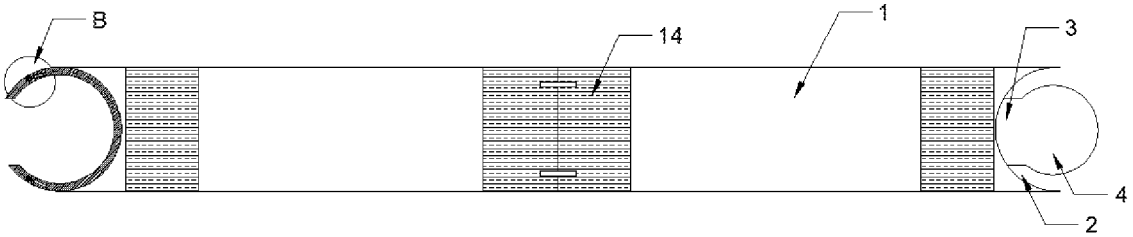
FIG. 5 is a top view of an environment-friendly acoustic panel for building according to one of the technical solutions of the present invention.
Figure 6:
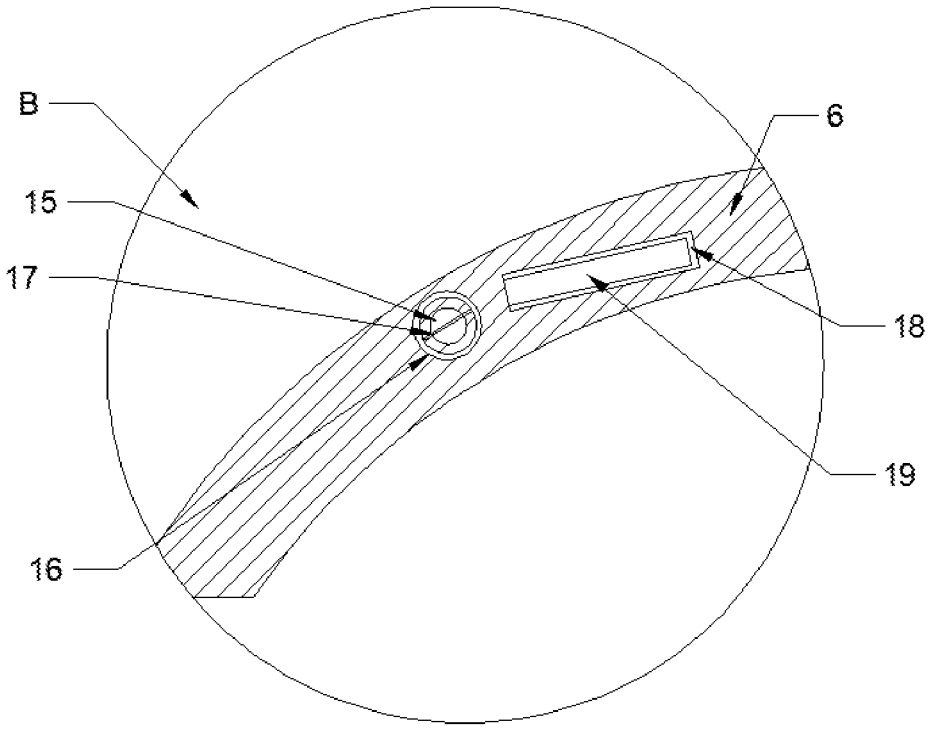
FIG. 6 is an enlarged drawing of B in FIG. 5.

In another technical solution, as shown in FIG. 5, four cover bodies 14 are further included. The four cover bodies 14 are respectively arranged in one-to-one correspondence with the top ends and the bottom ends of the first positioning groove 5 and the second positioning groove 2 (that is, the top end and the bottom end of the first positioning groove 5 are respectively provided with the cover body 14, and the end top and the bottom end of the second positioning groove 2 are respectively provided with the cover body 14, that is, each acoustic panel body is provided with four cover bodies 14), when the two acoustic panel bodies 1 are connected, the cover bodies 14 at the joint of the two acoustic panel bodies 1 are closed and then respectively connected with the top ends and the bottom ends of the first positioning groove 5 and the second positioning groove 2 (for example: after the two acoustic panel bodies 1 are connected, the top end at the joint of the two acoustic panel bodies 1 is covered after the cover body 14 at the top end of the first positioning groove 5 and the cover body 14 at the top end of the second positioning groove 2 at the joint are closed). According to this technical solution, the cover bodies 14 are arranged. On one hand, the two cover bodies 14 arranged up and down can effectively improve the connection stability of the two acoustic panel bodies 1 and prevent the two acoustic panel bodies 1 from moving up and down. On the other hand, the cover bodies 14 can protect the first positioning groove 5, the positioning cylinder 6, the second positioning groove 2 and the fixing block after being closed, thus effectively improving the acoustic insulation effect.

In another technical solution, the vertical portion 3 and the arc-shaped portion 4 are both of a hollow structure, the vertical portion 3 is communicated with the arc-shaped portion 4, and acoustic insulation materials are filled in the vertical portion 3 and the arc-shaped portion 4. By adopting this technical solution, the acoustic insulation effect at the joint of the two acoustic panel bodies 1 can be effectively improved.

In another technical solution, the acoustic insulation materials are filled in the positioning cylinder 6 (i.e., a gap between the positioning cylinder 6 and the arc-shaped portion 4 at the joint of two acoustic panel bodies 1) and a gap between the second positioning groove 2 and the positioning cylinder 6 at the joint of the two acoustic panel bodies 1. By adopting this technical solution, the acoustic insulation effect at the joint can be further improved.

In another technical solution, the acoustic insulation materials are acoustic insulation cotton. By adopting this technical solution, the acoustic insulation effect is improved.

In another technical solution, a sealing rubber layer is coated on a side wall of the positioning cylinder 6 outside the first positioning groove 5. By adopting this technical solution, a sealing property between the second positioning groove 2 and the side wall of the positioning cylinder 6 at the joint of the two acoustic panel bodies 1 can be effectively reduced, and the acoustic insulation effect can be improved.

The number and the processing scale of devices described herein are used to simplify the description of the present invention. The application, modification and variation of the environment-friendly acoustic panel for building for building of the present invention are obvious to those skilled in the art.

Although the implementation of the present invention has been disclosed above, it is not limited to the applications listed in the specification and the embodiments, and can be fully applied to various fields suitable for the present invention, and additional modifications can be easily implemented by those skilled in the art. Therefore, the present invention is not limited to the specific details and illustrations shown and described herein without departing from the general concept defined by the claims and the equivalent scope.

The invention claimed is:

1. An environment-friendly acoustic panel for building, comprising:

an acoustic panel body, which comprises a first positioning groove formed by recessing of one vertical edge of the acoustic panel body and a second positioning groove formed by recessing of the other vertical edge of the acoustic panel body, wherein the first positioning groove is arranged in a vertical length direction of the acoustic panel body and a length of the first positioning groove is equal to a vertical length of the acoustic panel body, a horizontal cross section of the first positioning groove is a semi-circular arc, a positioning cylinder with open top and bottom ends is fixedly arranged in the first positioning groove in a length direction of the first positioning groove, a length of the positioning cylinder is equal to that of the first positioning groove, the positioning cylinder is provided with an opening in an outer side wall of the first positioning groove, the opening is arranged in a length direction of the positioning cylinder and a length of the opening is equal to that of the positioning cylinder, the second positioning groove is arranged in a vertical length of the acoustic panel body and a length of the second positioning groove is equal to the vertical length of the acoustic panel body, a horizontal cross section of the second positioning groove is a semi-circular arc, a fixing block is arranged in the second positioning groove, the fixing block comprises a vertical portion arranged in a length direction of the second positioning groove and an arc-shaped portion integrally formed with the vertical portion, a horizontal cross section of the arc-shaped portion is a major arc and a diameter of the major arc is larger than a width of the vertical portion, wherein the width of the vertical portion is slightly smaller than a width of the opening; and two sets of sealing assemblies, wherein the two sets of sealing assemblies are respectively arranged in one-to-one correspondence with two vertical edges of the opening, the sealing assembly comprises an accommodating groove formed by outwardly recessing of the vertical edge of the opening, a length of the accommodating groove is slightly smaller than the length of the opening, a bottom portion of the accommodating groove is provided with a plurality of springs at intervals up and down, end portions of the plurality of springs are jointly connected with a positioning plate, a length of the positioning plate is slightly smaller than that of the accommodating groove, the positioning plate is slidably connected with a side wall of the accommodating groove, a surface of the positioning plate facing away from the springs is fixedly provided with a sealing block, and the sealing block is hermetically and slidably connected with the side wall of the accommodating groove, wherein two steel wire ropes are connected onto a surface of the positioning plate connected with the springs, the two steel wire ropes are respectively located at an upper portion and a lower portion of the positioning plate, the steel wire rope located at the upper portion slides through a top end of the positioning cylinder, while the steel wire rope located at the lower portion slides through a bottom end of the positioning cylinder;

wherein, when two acoustic panel bodies are connected, the arc-shaped portion of one acoustic panel body is located in the positioning cylinder of the other acoustic panel body, two sealing blocks corresponding to the positioning cylinder abut against the vertical portion, top ends and bottom ends of the two acoustic panel bodies are flush, and surfaces of the two acoustic panel bodies are flush.

2. The environment-friendly acoustic panel for building according to claim 1, wherein the top end and the bottom end of the positioning cylinder are both provided with a through hole, the through hole is communicated with the accommodating groove, two fixed pulleys are arranged between the bottom portion of the accommodating groove and the positioning plate, the two fixed pulleys are arranged in one-to-one correspondence with the two steel wire ropes, and a free end of the steel wire rope sequentially passes through the fixed pulley and the through hole corresponding to the free end of the steel wire rope and then extends out of the accommodating groove.

3. The environment-friendly acoustic panel for building according to claim 2, wherein the free ends of the steel wire ropes are both provided with a positioning ring; and four sets of fixing assemblies are further comprised, the four sets of fixing assemblies are arranged in one-to-one correspondence with four through holes, each set of fixing assembly comprises a fixing groove formed by recessing of an end portion of the positioning cylinder, a fixing column is hinged in the fixing groove, and a rotation angle of the fixing column is 90°.

4. The environment-friendly acoustic panel for building according to claim 1, further comprising four cover bodies, wherein the four cover bodies are respectively arranged in one-to-one correspondence with the top ends and the bottom ends of the first positioning groove and the second positioning groove, when the two acoustic panel bodies are connected, the cover bodies at the joint of the two acoustic panel bodies are closed and then respectively connected with the top ends and the bottom ends of the first positioning groove and the second positioning groove.

5. The environment-friendly acoustic panel for building according to claim 1, wherein the vertical portion and the arc-shaped portion are both of a hollow structure, the vertical portion is communicated with the arc-shaped portion, and acoustic insulation materials are filled in the vertical portion and the arc-shaped portion.

6. The environment-friendly acoustic panel for building according to claim 5, wherein the acoustic insulation materials are filled in the positioning cylinder and a gap between the second positioning groove and the positioning cylinder at the joint of the two acoustic panel bodies.

7. The environment-friendly acoustic panel for building according to claim 6, wherein the acoustic insulation materials are acoustic insulation cotton.

8. The environment-friendly acoustic panel for building according to claim 1, wherein a sealing rubber layer is coated on a side wall of the positioning cylinder outside the first positioning groove.

* * * * *